United States Patent [19]

Carroll

[11] Patent Number: 4,525,899

[45] Date of Patent: Jul. 2, 1985

[54] PAPER FASTENER

[75] Inventor: Richard A. Carroll, Cranston, R.I.

[73] Assignee: Quality Services Incorporated, Cranston, R.I.

[21] Appl. No.: 507,999

[22] Filed: Jun. 27, 1983

[51] Int. Cl.[3] ..... B42F 3/00

[52] U.S. Cl. ..... 24/67 P; 24/67 R; 24/67.11; 24/545

[58] Field of Search ..... 24/67 R, 67 AR, 67 PR, 24/67.5, 67.7, 67.11, 545, 521, 260, 261, 262

[56] References Cited

U.S. PATENT DOCUMENTS

| | | | |
|---|---|---|---|
| 547,335 | 10/1895 | Crocker | 24/67 PR |
| 684,145 | 10/1901 | Watt | 24/67 PR |
| 3,296,673 | 1/1967 | Kirkpatrick | 24/67 R |
| 3,315,325 | 4/1967 | Cornelius | 24/67 AR |
| 3,399,429 | 9/1968 | Goodman | 24/67 AR |
| 3,561,077 | 2/1971 | Grant | 24/67.11 |
| 3,629,912 | 4/1970 | Klopp | 24/457 |
| 3,896,527 | 7/1975 | Miller et al. | 24/521 |
| 4,241,477 | 12/1980 | Freedom et al. | 24/67 P |
| 4,277,864 | 7/1981 | Orson, Sr. | 24/545 |

*Primary Examiner*—Victor N. Sakran

*Attorney, Agent, or Firm*—Salter & Michaelson

[57] ABSTRACT

A fastener for paper and the like is integrally molded of a plastic material and comprises hingedly interconnected first and second plate members, each having a mating surface thereon, and a wedge-shaped prong which extends from the mating surface of the first plate member. The prong is receivable in frictional interengagement in a slot in the second plate member to detachably maintain the plate members in the closed positions thereof, wherein the abutting surfaces thereof are in mating relation. One or a plurality of sheets of paper or the like interposed between the plate members are penetrated by the prong when the plate members are in the closed positions thereof to secure the sheets in the fastener.

1 Claim, 10 Drawing Figures

PAPER FASTENER

BACKGROUND AND SUMMARY OF THE INVENTION

The instant invention relates to a fastener for paper and the like and more particularly to a detachable fastener which is integrally molded from a plastic material.

A variety of paper fasteners have heretofore been available, including one-piece fasteners which are detachable. In this connection, the fasteners disclosed in the U.S. patent to Crocker #547,335, Watt #684,145, McCallum #843,960, Kepner #916,716, and Bleakney #1,054,498 represent the closest prior art to the instant invention of which the applicant is aware. Although these references relate generally to detachable fasteners, they do not teach an integrally molded plastic fastener constructed in accordance with the instant invention. Specifically, they do not teach a fastener having hingedly interconnected first and second plate members and a wedge-shaped prong which projects from the second plate member and is receivable in frictional interengagement in a slot in the first plate member to detachably secure the fastener in a closed position. Accordingly, the above-cited references are believed to be of nothing more than general interest.

The fastener of the instant invention comprises a first plate member having a mating surface thereon and having a slot therein, a second plate member having a mating surface thereon, and a living hinge which hingedly interconnects the first and second plate members so that the mating surfaces thereof are positionable in abutting relation. A wedge-shaped prong projects from the mating surface of the second plate member and is dimensioned and configured to be received in frictional interengagement in the slot in the first plate member to detachably secure the fastener in a closed position wherein the first and second plate members are disposed with the mating surfaces thereof in abutting or mating relation. Hence the fastener is operable for detachably securing a sheet of paper or the like between the plate members, the paper being penetrated by the prong when the fastener is in the closed position thereof to retain the paper therebetween. The prong is preferably of wedge-shaped configuration to enhance the frictional interengagement thereof in the slot and in one embodiment includes enlarged shoulders or the like whereby it is snap-receivable in the slot. An alternate embodiment of the fastener further comprises a frame which projects from the surface of the first plate member which is opposite the mating surface thereof and extends around the periphery of the slot. The frame is dimensioned so that when the prong is received in the slot, the frame projects outwardly from the first plate member a distance greater than the prong, whereby a user of the fastener can grasp it between the thumb and forefinger to position the fastener in the closed position thereof, and the engagement of the tip of the prong with the thumb or forefinger of the user is avoided. In another embodiment of the fastener, the first plate member is of enlarged sectional dimension so that the fastener can be grasped between the thumb and forefinger and moved to a closed position without the prong engaging the user. In still another embodiment of the instant invention, the first plate member is of enlarged sectional dimension, and the slot extends only partially therethrough so that a skin or covering is provided over the slot to provide a smooth outer surface on the first plate member. The fastener of the instant invention can also be embodied with an adhesive means on the outer surface of one of the plate members for securing the fastener on a wall or other supporting surface.

Accordingly, it is a primary object of the instant invention to provide a fastener for paper and the like which is integrally molded of a plastic material and has a wedge-shaped prong which is receivable in frictional interengagement in a slot to maintain the fastener in a closed position.

Another object of the instant invention is to provide a molded plastic fastener which is detachably interconnectable.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
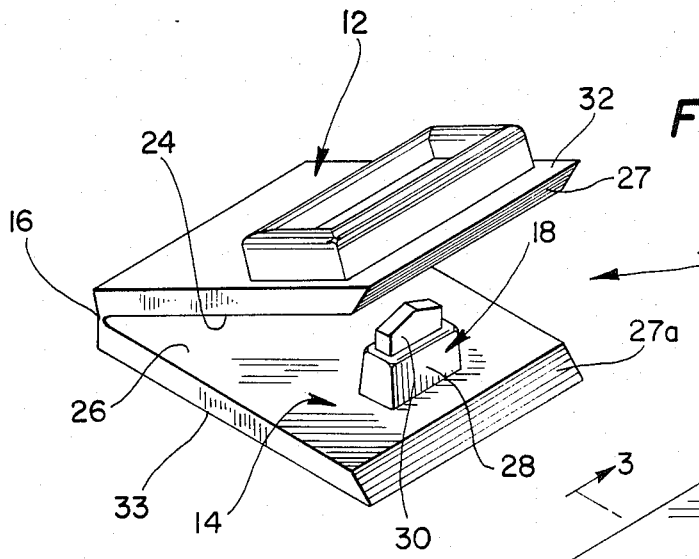
FIG. 1 is a perspective view of a first embodiment of the fastener of the instant invention.
Figure 2:
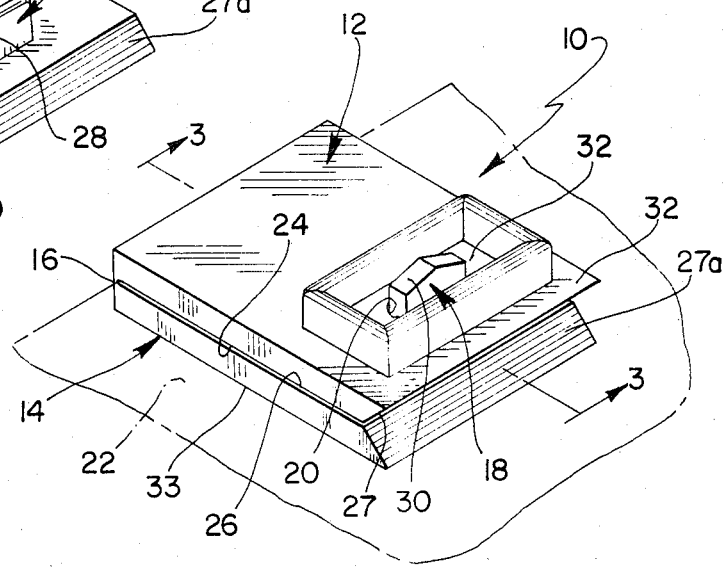
FIG. 2 is a perspective view thereof in a closed position with a sheet of paper or the like secured therein.
Figure 3:
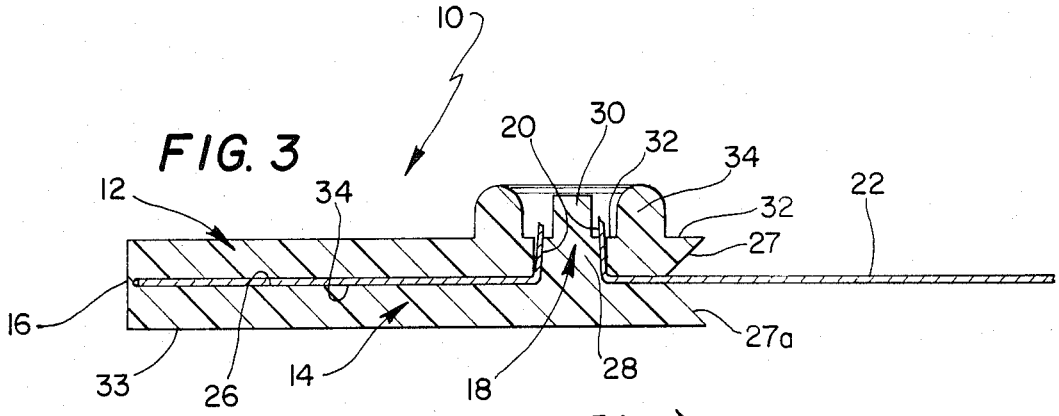
FIG. 3 is a sectional view thereof taken along line 3—3 in FIG. 2.
Figure 4:
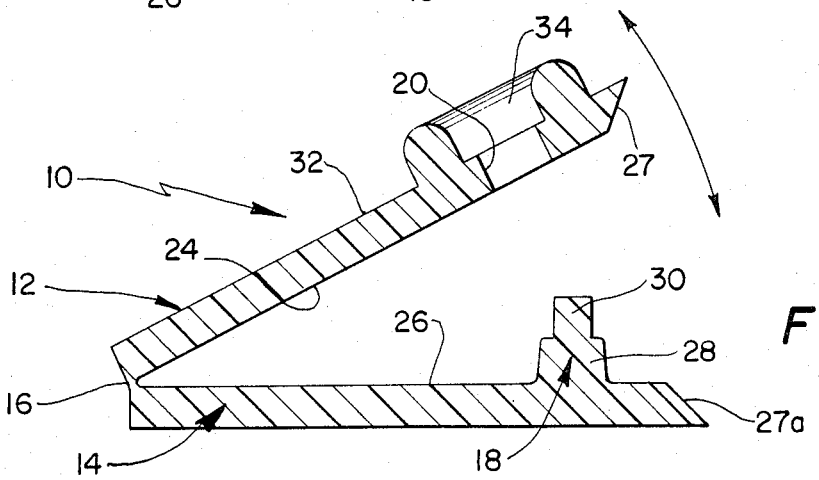
FIG. 4 is a sectional view of the fastener in the open position.

Referring now to the drawing, a first embodiment of the fastener of the instant invention is illustrated in FIGS. 1 through 4 and generally indicated at 10. The fastener 10 is integrally molded of a plastic material, such as polypropylene, and generally comprises a first plate member 12, a second plate member 14, a living hinge 16 which hingedly interconnects the first and second plate members 12 and 14, respectively, and a prong 18 which integrally extends from the second plate member 14. A slot 20 is provided in the first plate member 12, and the prong 18 is dimensioned and configured to be received in frictional interengagement in the slot 20. Accordingly, as illustrated in FIGS. 2 and 3, a sheet of paper 22 is receivable between the first and second plate members 12 and 14 so that the prong 18 penetrates the paper 22 to secure it in the fastener 10.

As above mentioned, the fastener 10 is integrally molded of a suitable plastic material. The first and second plate members 12 and 14, which may be of various desired configurations, are preferably formed with substantially flat mating surfaces 24 and 26 and outwardly bevelled outer edges 27 and 27*a*, respectively; and the living hinge 16 is defined by an area of plastic material of reduced thickness which interconnects the first and second plate members 12 and 14 so that they are hingeable to a closed position of the fastener 10 wherein the mating surfaces 24 and 26 are in mating relation, as illustrated in FIGS. 2 and 3. The prong 18 projects integrally from the surface 26 of the second plate member 14 and comprises a wedge-shaped base portion 28 which is dimensioned and configured so that it is receivable in frictional interengagement in the slot 20, and a terminal portion 30 which projects from the base portion 28 and has a slightly pointed configuration. The first and second plate members 12 and 14 also include second surfaces 32 and 33, respectively, thereof which are opposite the mating surfaces 24 and 26, respectively, and a frame 34 integrally extends from the second surface 32 around the slot 20. As will be seen most clearly from FIG. 3, the frame 34 is dimensioned so that when the fastener 10 is in the closed position thereof wherein the surfaces 24 and 26 are in mating relation and the prong 18 is received in the slot 20 so that it projects outwardly from the surface 32, the frame 34 projects a slightly greater distance outwardly from the surface 32 than the prong 18. Accordingly, a user can operate the fastener 10 by grasping it between the thumb and forefinger to move the plate members 12 and 14 together so that the prong 18 is received in the slot 20 and so that the mating surfaces 24 and 26 are moved into mating relation, and the frame 34 prevents the prong 18 from engaging the user's thumb or forefinger during this operation. The fastener 10 can be detachably secured to one or a plurality of sheets of paper 22, as illustrated in FIGS. 2 and 3. In this connection, when the fastener 10 is moved to the closed position thereof, the prong 18 penetrates the paper 22 so that portions thereof are trapped or sandwiched between the wedge-shaped base portion 28 and the sides of the slot 20. In this manner, the paper 22 is securely retained in the fastener 10, and the portions of the paper 22 which are sandwiched between the prong 18 and the walls of the slot 20 enhance the wedge-like interlocking of the prong 18 in the slot 20 to retain the fastener 10 in the closed position thereof. The bevelled outer edges 27 and **27*a* facilitate the detachment of the fastener 10 from the paper 22 by providing an area wherein a user can insert a thumbnail or the like to separate the plate members 12 and 14. Thus it will be seen that the fastener 10** is capable of functioning as a reusable staple.

Figure 5:
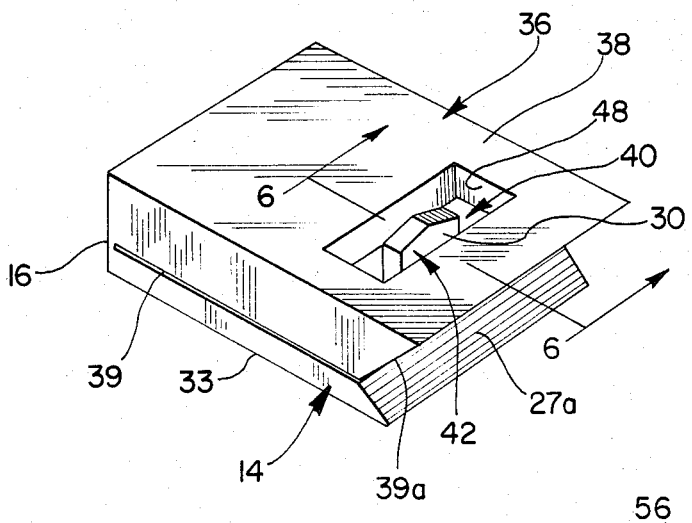
FIG. 5 is a perspective view of a second embodiment of the fastener of the instant invention.
Figure 6:
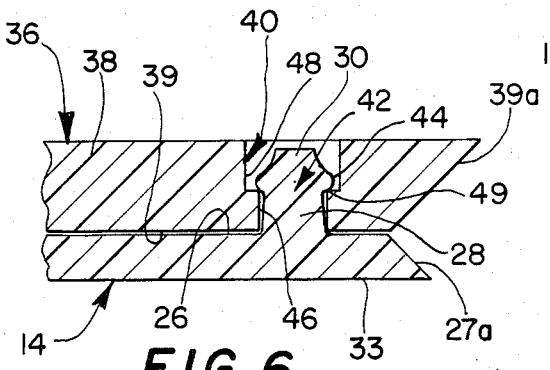
FIG. 6 is a sectional view thereof taken along line 6—6 in FIG. 5.

A second embodiment of the fastener of the instant invention is illustrated in FIG. 5 and generally indicated at 36. The fastener 36 is also integrally molded of a suitable rigid plastic material and comprises a first plate member 38 having a mating surface 39 and a bevelled outer edge **39*a* and having a slot 40 therein, a second plate member 14, a living hinge 16 which hingedly interconnects the plate members 14 and 38, and a prong 42 which integrally extends from the second plate member 14. The first plate member 38 is of increased thickness relative to the first plate member 12 of the fastener 10, and therefore the fastener 36 does not include a frame 34. In this regard, as illustrated in FIG. 6, the first plate member 38 is dimensioned so that when the fastener 36 is in the closed position thereof wherein the prong 42 is received in the slot 40, the terminal end of the prong 42 is recessed slightly below the outer surface of the first plate member 38, whereby the engagement of the prong 42 with the thumb or forefinger of a user during operation of the fastener 36 is avoided. The prong 42 is similar in configuration to the prong 18 of the fastener 10 and comprises a wedge-shaped base portion 28 and a slightly pointed upper portion 30. The prong 42 further comprises slightly enlarged pumps or shoulders 44 on the sides thereof whereby the prong 42 is snap-receivable in the slot 40 in order to more positively retain it therein. In this regard, it will be seen that the slot 40 comprises a restricted lower portion 46 which is of substantially the same configuration as the slot 20 and an enlarged upper portion 48. The prong 42 is dimensioned so that the shoulders 44 engage the end of the lower portion 46 as at 49 when the prong 42 is snap-received in the slot 40 whereby the first and second plate members 38 and 14**, respectively, are securely but detachably maintained in the closed positions thereof.

Figure 7:
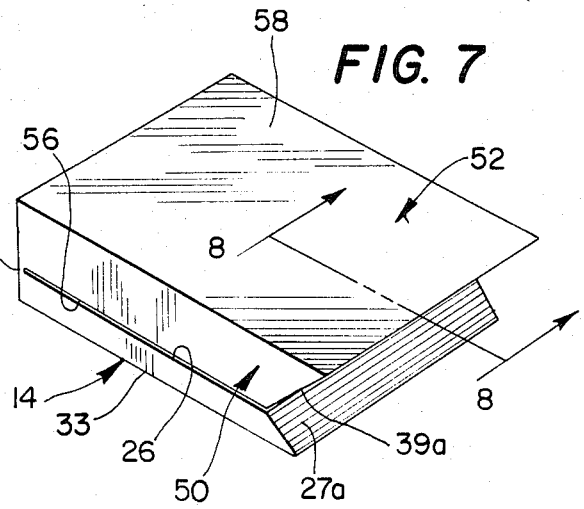
FIG. 7 is a perspective view of a third embodiment of the fastener.
Figure 8:
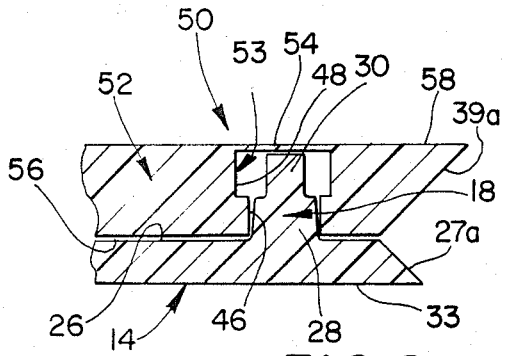
FIG. 8 is a sectional view taken along line 8—8 in FIG. 7.

A third embodiment of the fastener of the instant invention is illustrated in FIGS. 7 and 8 and generally indicated at 50. The fastener 50 comprises a first plate member 52 which is similar in configuration to the plate member 38 of the fastener 36 but has a slot 53 therein which extends only partially through the plate member 52 so that a skin or covering 54 is defined over the outer end of the slot 53. The slot 53 is generally similar in configuration to the slot 20, having a lower portion 46 wherein the prong 18 thereof is receivable in frictional interengagement and an enlarged upper portion 48. The fastener 50 further comprises a second plate member 14, a living hinge 16 which detachably interconnects the first plate member 52 to the second plate member 14, and a prong 18. The first plate member 52 includes a mating surface 56 which is receivable in mating relation with the mating surface 26 of the second plate member 14. The fastener 50 is also operable by grasping it between the thumb and forefinger in the manner hereinabove described; and since the slot 53 extends less than completely through the first plate member 52, a smooth outer surface 58 can be provided on the plate member 52 for providing a logo or the like on the fastener 50.

Figure 9:
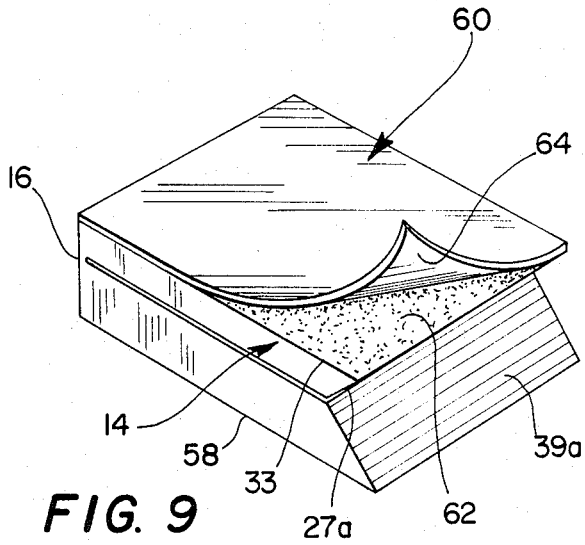
FIG. 9 is a perspective view of a fourth embodiment of the fastener of the instant invention.
Figure 10:
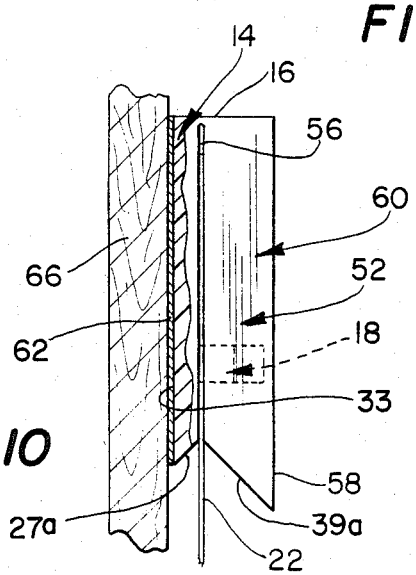
FIG. 10 is an elevational view thereof partially in section, the fastener being adhered to a wall.

A fourth embodiment of the fastener of the instant invention is illustrated in FIGS. 9 and 10 and generally indicated at 60. The fastener 60 is substantially the same as the fastener 50 but further comprises an adhesive layer 62 on the second surface 33 of the second plate member 14 thereof. A removable sheet 64 is provided overlying the adhesive layer 62 as a covering therefor prior to use. The sheet 64 is removable to expose the adhesive layer 62 whereupon the fastener 60 can be adhered to a wall or other supporting surface, such as the one indicated at 66 in FIG. 10. Accordingly, the fastener 60 is operable for securing a paper 22 and suspending it from the wall 66 as illustrated.

It is seen, therefore, that the instant invention provides an effective fastener which is simply and easily detachably securable to one or a plurality of sheets of paper or the like. The fasteners 10, 36, 50, and 60 can be embodied in various suitable configurations as desired. The novel configurations of the prongs 18 and 42 and the novel way in which they are receivable in frictional interengagement in the respective slots of the fasteners 10, 36, 50, and 60 provide novel and effective means for detachably maintaining the plate members of the respective fasteners in the closed positions thereof. Further, when a sheet of paper or the like is penetrated by the respective prong of one of the fasteners 10, 36, 50 or 60, the portions of the paper adjacent the penetrated area thereof become wedged or "sandwiched" between the respective prong and slot to enhance the retention of the respective plate members in the closed positions thereof. In addition, the fastener of the instant invention, which is integrally molded of a plastic material, is rugged and durable but can easily be moved to the open position thereof when desired for the detachment of a sheet of paper or the like therefrom. Accordingly, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A fastener for paper and the like comprising:

(a) a first plate member made of a plastic material and having a slot therethrough, said first plate member having a mating surface and having a second surface which is opposite said mating surface;

(b) a second plate member made of said plastic material and having a mating surface;

(c) a living hinge integrally interconnecting said first and second plate members so that they are positionable with the mating surfaces thereof in mating relation;

(d) a prong integrally formed with said second plate member and projecting from the mating surface thereof, said prong being configured and dimensioned to be received in frictional interengagement in said slot when said first and second plate members are positioned with the mating surfaces thereof in mating relation, whereby said first and second plate members are securable in a closed position wherein the mating surfaces thereof are in mating relation so that a sheet of paper or the like disposed between said surfaces is penetrated by said prong and thereby retained in said fastener; and (e) a frame integrally formed with said first plate member and extending around the periphery of said slot on the second surface of said first plate member, said frame being dimensioned so that when said prong is received in interengagement in said slot, said frame projects outwardly from said first plate member second surface a greater distance than said prong.

* * * * *